US007415219B2

(12) United States Patent
Kawamata

(10) Patent No.: US 7,415,219 B2
(45) Date of Patent: Aug. 19, 2008

(54) SHEET CARRIER AND IMAGE FORMATION APPARATUS WITH VENTILATION SYSTEM TO BLOW AIR AGAINST PREDETERMINED MEMBERS THEREIN

(75) Inventor: Kunimasa Kawamata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 154 days.

(21) Appl. No.: 11/353,960

(22) Filed: Feb. 15, 2006

(65) Prior Publication Data

US 2007/0019981 A1 Jan. 25, 2007

(30) Foreign Application Priority Data

Jul. 22, 2005 (JP) ..... 2005-212675

(51) Int. Cl.
*G03G 21/20* (2006.01)

(52) U.S. Cl. ..... 399/92

(58) Field of Classification Search ..... 399/91–93
See application file for complete search history.

(56) References Cited

U.S. PATENT DOCUMENTS

| | | | | |
|---|---|---|---|---|
| 6,272,311 | B1 | 8/2001 | Baughman et al. | |
| 6,522,847 | B2 * | 2/2003 | Nanjo | 399/92 |
| 2007/0019981 | A1 | 1/2007 | Kawamata | |

FOREIGN PATENT DOCUMENTS

| | | | |
|---|---|---|---|
| JP | 05-024711 | | 2/1993 |
| JP | 9-114286 | A | 5/1997 |
| JP | 11-349184 | A | 12/1999 |
| JP | 2000-75709 | A | 3/2000 |
| JP | 2000-259063 | | 9/2000 |
| JP | 2001-63890 | A | 3/2001 |
| JP | 2001-100620 | A | 4/2001 |
| JP | 2004-109356 | A | 4/2004 |
| JP | 2005-112568 | A | 4/2005 |
| JP | 2007-33520 | | 2/2007 |

* cited by examiner

*Primary Examiner*—Hoang Ngo
(74) *Attorney, Agent, or Firm*—Sughrue Mion, PLLC

(57) ABSTRACT

In a sheet carrier of an image-forming apparatus, a gate, a carrier guide and a cover are cooled by air exhausted from an exhaust port of a guiding guide and an exhaust hole of the gate, and dew condensation is prevented. A recording paper where a full color toner image is fixed to one side is cooled by blowing the air exhausted from the exhaust port of the guiding guide and the exhaust hole of the gate against the recording paper. A pinch roller and a detection sensor are cooled by blowing the air exhausted from the exhaust port of the guiding guide and the exhaust hole of the gate against the pinch roller and the detection sensor. Since a heat of a fixing device is not absorbed by applying the air to the fixing device, no unnecessary surplus energy is consumed for maintaining a temperature required for fixing.

16 Claims, 8 Drawing Sheets

SHEET CARRIER AND IMAGE FORMATION APPARATUS WITH VENTILATION SYSTEM TO BLOW AIR AGAINST PREDETERMINED MEMBERS THEREIN

CROSS-REFERENCE TO RELATED APPLICATION

This application claims priority under 35 USC 119 from Japanese Patent Application No. 2005-212675, the disclosure of which is incorporated by reference herein.

TECHNICAL FIELD

The present invention relates to a sheet carrier and an image formation apparatus provided with the sheet carrier.

DESCRIPTION OF THE RELATED ART

For image formation apparatuses, there has been proposed a structure which adsorbs a recording paper to a guide surface and stably conveys the recording paper by circulating air in a hollow portion of a hollow cylindrical guide guiding the recording paper and sucking the air from a slit formed in the guide surface (refer to, for example, Japanese Patent Application Laid-Open (JP-A) No. 06-24071).

Further, in order to prevent dew condensation of the guide plate guiding the recording paper, there has been proposed a structure in which a through hole is formed in a movable branch member branching a carrier path in a double-sided printing mechanism so as to provide ventilation (refer to, for example, Japanese Patent Application Laid-Open (JP-A) No. 2001-316018 (JPA'018))

However, JPA'018 relates to a structure for cooling the entire carrier path of the recording paper, and it is impossible to blow the air only against a predetermined member to be cooled so as to cool it.

SUMMARY OF THE INVENTION

The present invention is made for solving the problem mentioned above. In an image forming apparatus or a sheet carrier, air is blown against a predetermined member.

According to a first aspect of the invention, there is provided a sheet carrier comprising a guide guiding a sheet, a ventilation path at least a part of which is constituted by the guide, and an exhaust portion formed in the guide, exhausting air blown against the ventilation path by a blower portion and blowing the air to a predetermined member.

The sheet carrier blows the air to the ventilation path at least a part of which is constituted by the guide guiding the sheet, toward the predetermined member from the exhaust portion formed in the guide. In other words, the air is blown against the predetermined member so as to cool it by utilizing the guide guiding the sheet. Accordingly, the predetermined member can be cooled without enlarging the size of the apparatus.

DETAILED DESCRIPTION OF THE INVENTION

Figure 1:
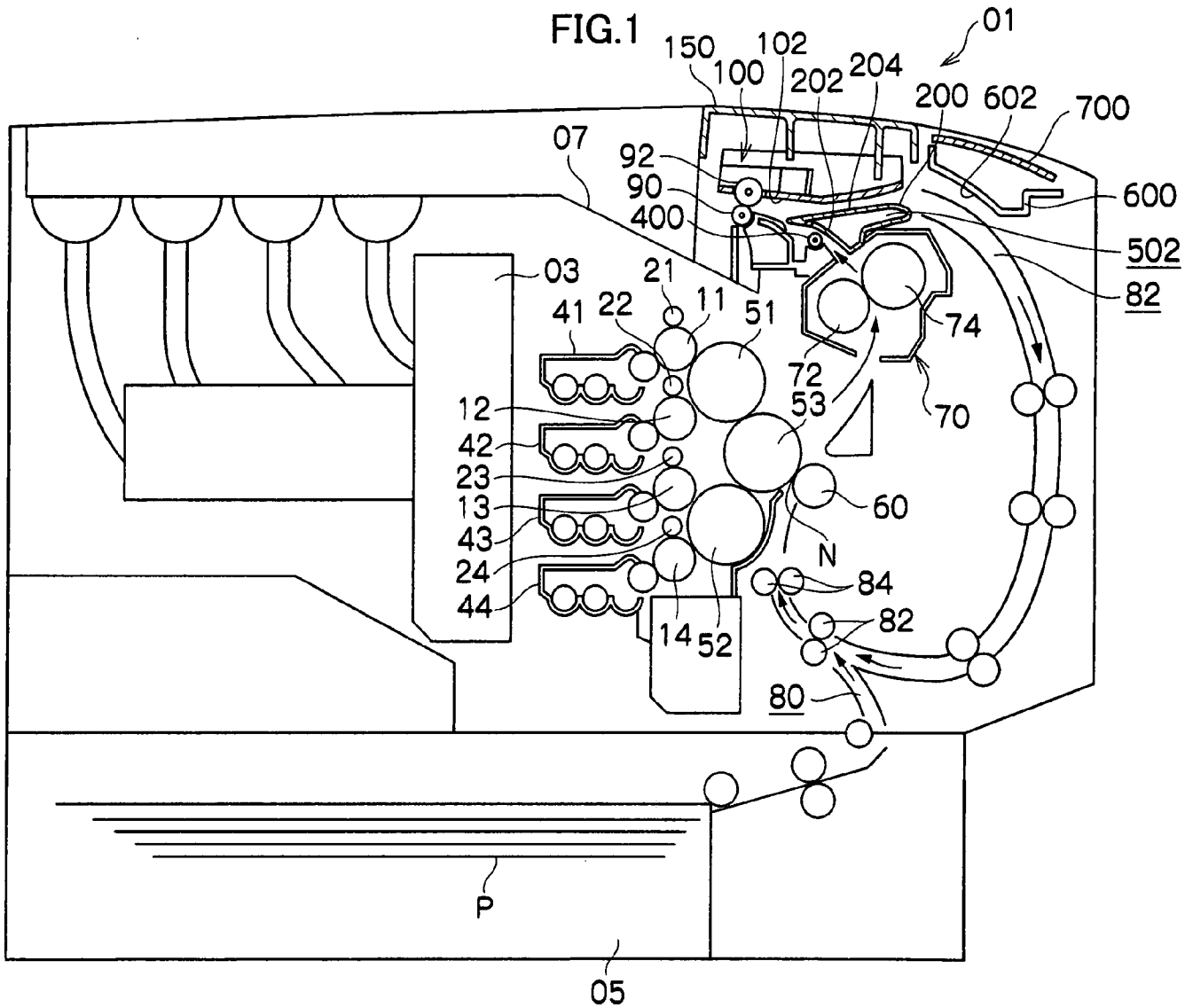
FIG. 1 is a configurational schematic view showing an image formation apparatus according to an embodiment of the present invention.

An embodiment according to the present invention will be explained in detail below with reference to the accompanying drawings.

First, a schematic configuration of an image formation apparatus 01, and an image formation process per colors according to a well-known electrophotographic method will be explained. In this case, in FIG. 1, the right side shows a front surface of the apparatus (a near side of the apparatus), and the left side shows a back side of the apparatus. Further, an axial direction orthogonal to FIG. 1 corresponds to a width direction of a recording paper P.

First, photo conductor drums 11, 12, 13 and 14 are electrostatically charged by electrostatic charge rolls 21, 22, 23 and 24. In the charged photo conductor drums 11, 12, 13 and 14, laser beams corresponding to respective colors comprising yellow (Y), magenta (M), cyan (C) and black (K) are irradiated by a light scanning apparatus 03, and electrostatic latent images corresponding to input image information per the respective colors are formed. The electrostatic latent images corresponding to the respective colors comprising yellow (Y), magenta (M), cyan (C) and black (K) formed on the surfaces of the photo conductor drums 11, 12, 13 and 14 are developed by developing apparatuses 41, 42, 43 and 44 for the corresponding colors, and toner images of the respective colors comprising yellow (Y), magenta (M), cyan (C) and black (K) are formed on the photo conductor drums 11, 12, 13 and 14.

The toner images of the yellow (Y) and magenta (M) colors formed on the photo conductor drums 11 and 12 are transferred on a first primary intermediate transfer drum 51, and the toner images of the cyan (C) and black (K) colors formed on the photo conductor drums 13 and 14 are transferred on a second primary intermediate transfer drum 52.

The toner images of the respective colors formed on the first and second primary intermediate transfer drums 51 and 52 are transferred onto a secondary intermediate transfer drum 53. Accordingly, the respective color toner images of the yellow (Y), magenta (M), cyan (C) and black (K) colors are overlapped, and a final overlapped full color toner image is formed on the secondary intermediate transfer drum 53.

On the other hand, a recording paper P is supplied from a paper feed cassette 05 arranged in a lower portion of the image formation apparatus 01, and is conveyed along a paper carrier path 80.

The recording paper P is fed to an upper side by roll pair 82 and 84 and the like, and is thereafter fed to a nip portion N between the secondary intermediate transfer drum 53 and a final transfer roll 60. Further, the full color toner image formed on the secondary intermediate transfer drum 53 is transferred to the recording paper P. The recording paper P to which the full color toner image is transferred is conveyed to a fixing device 70, and is pressurized and heated by a fixing nip between a heat roll 72 and a pressure roll 74, whereby the full color toner image is fixed. In this case, rotation axes of the heat roll 72 and the pressure roll 74 are set in the same direction as the width direction mentioned above.

Figure 4:
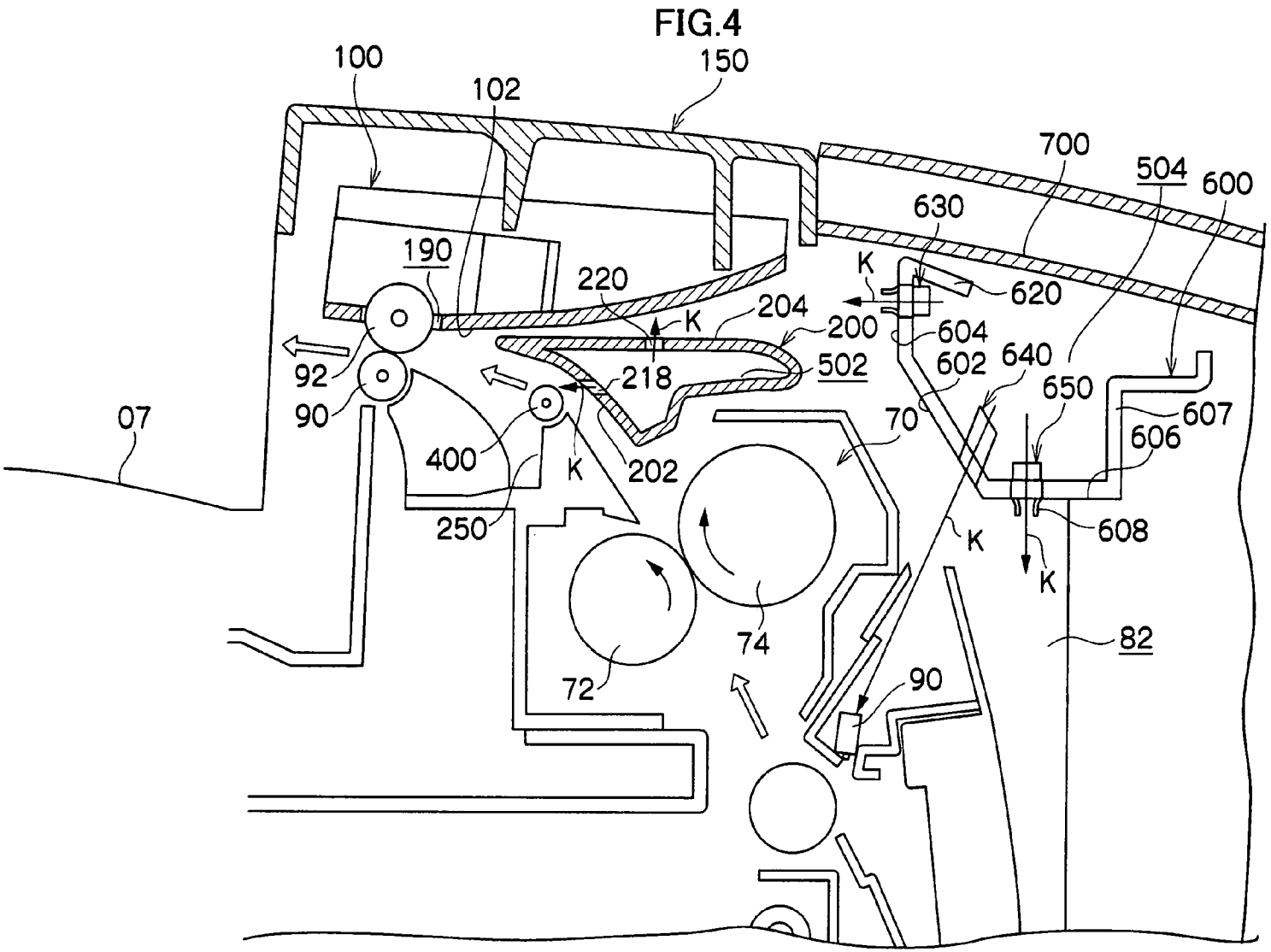
FIG. 4 is a view of a state in which a gate is rotated upward, and shows a portion near a fixing device of the image formation apparatus.

As shown in FIG. 4, the recording paper P sent out from the fixing device 70 is guided by a first surface 202 of a hollow gate 200 having a substantially triangular cross-sectional shape and a pinch roll 400, and is thereafter guided by a guide surface 102 of a carrier guide 100. Further, the recording paper P is discharged to a paper discharge tray 07 arranged in an upper portion of the image formation apparatus 01 by paper discharge rolls 90 and 92, from the front surface side toward the back side (from the right side toward the left side in FIG. 1). In this case, a leading end of the gate 200 is rotated up and down by a rotation mechanism (not shown).

In this case, the image formation apparatus 01 is provided with a double-sided printing mechanism printing on both sides of the recording paper P. Accordingly, explanation will be given next on double-sided printing.

The full color toner image is fixed to one surface by the fixing device 70, and the recording paper P guided by the first surface 202 of the gate 200 is conveyed in a switchback manner due to a reverse rotation of the paper discharge rolls 90 and 92.

Figure 5:
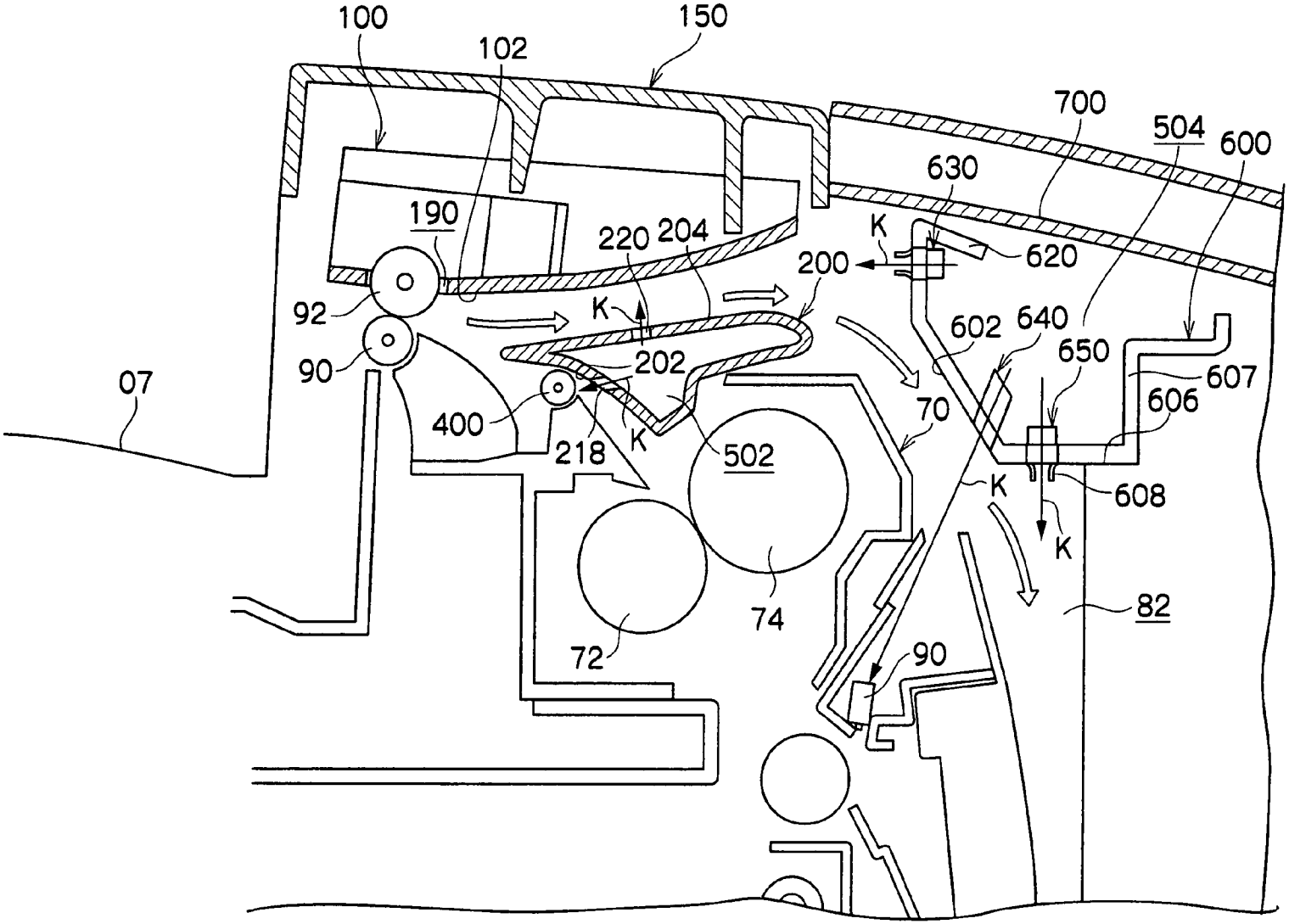
FIG. 5 is a view of a state in which the gate is rotated downward, and shows the portion near the fixing device of the image formation apparatus.

At this time, as shown in FIG. 5, the leading end of the gate 200 is rotated downward, and the recording paper P is guided by a second surface 204 of the gate 200, and is thereafter guided to a double-sided carrier path 82 by a guide surface 602 of a guiding guide 600.

Further, as shown in FIG. 1, the recording paper P guided to the double-sided carrier path 82 is reversed, and is again fed to the nip portion N between the secondary intermediate transfer drum 53 and the final transfer roll 60. Further, the full color toner image formed on the secondary intermediate transfer drum 53 is transferred on a back side (a side on which the full color toner image is not fixed). The recording paper P in which the full color toner image is transferred on the back side is conveyed to the fixing device 70, and the full color toner image is fixed to the back side.

The recording paper P which is discharged from the fixing device 70 and in which the full color image is fixed on both sides is guided by the first surface 202 of the upward rotating gate 200, the pinch roll 400 and the carrier guide 100 as shown in FIG. 4, and is thereafter discharged to the paper discharge tray 07 by the paper discharge rolls 90 and 92.

Next, explanation will be given regarding a structure near the fixing device 70 and an airflow. In this case, in each of the drawings, an arrow K denotes an airflow.

As shown in FIGS. 4 and 5, the gate 200, the carrier guide 100 and the cover 150 are sequentially arranged in an upper side of the fixing device 70. In this case, the gate 200 is rotated as mentioned above. Further, the guiding guide 600 is arranged in an upper portion in a front surface side of the apparatus. Further, a cover 700 is arranged in an upper side of the guiding cover 600 so as to cover an upper opening of the guiding guide 600.

Figure 2:
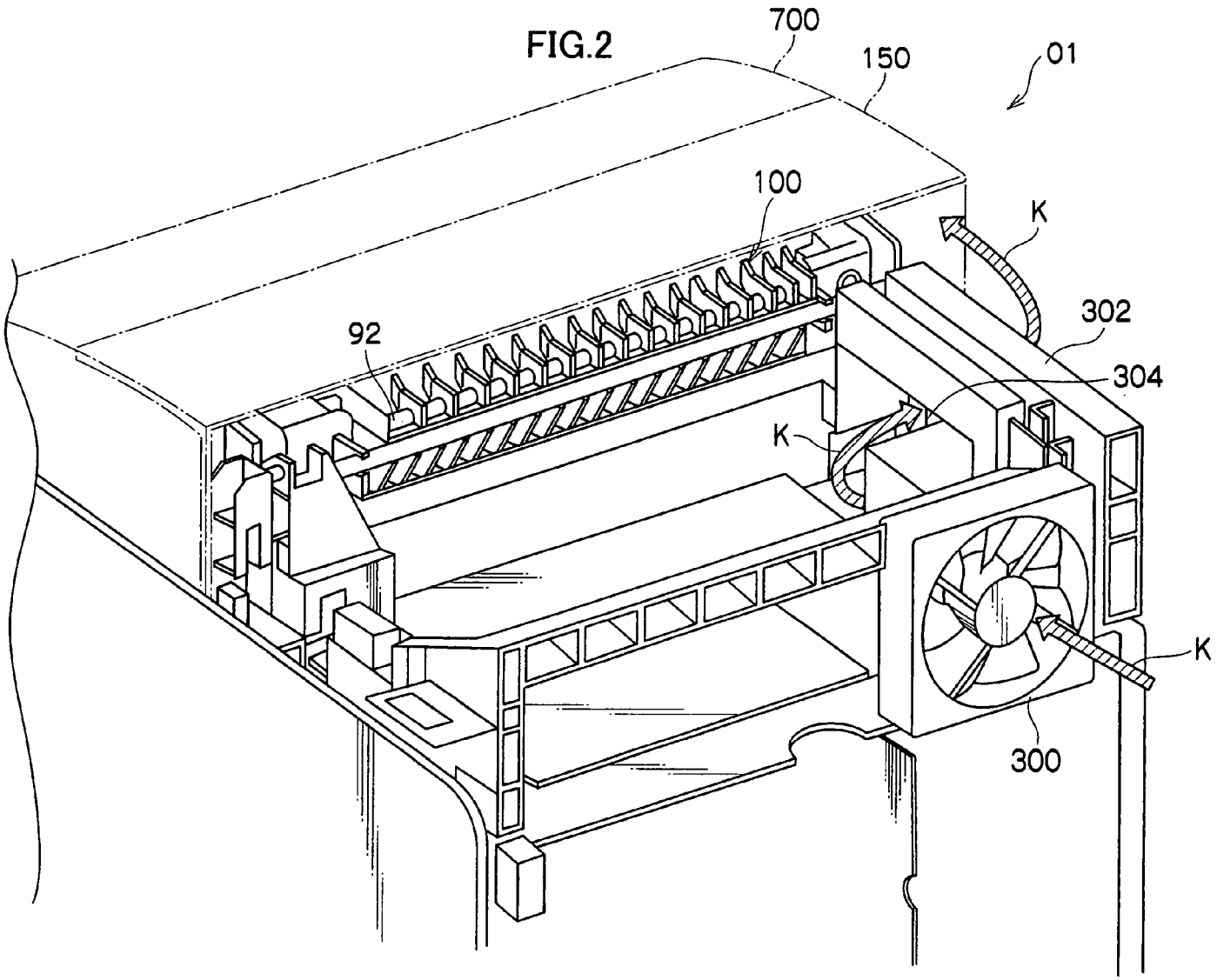
FIG. 2 is a view showing an airflow in an inner portion of the image formation apparatus.
Figure 3:
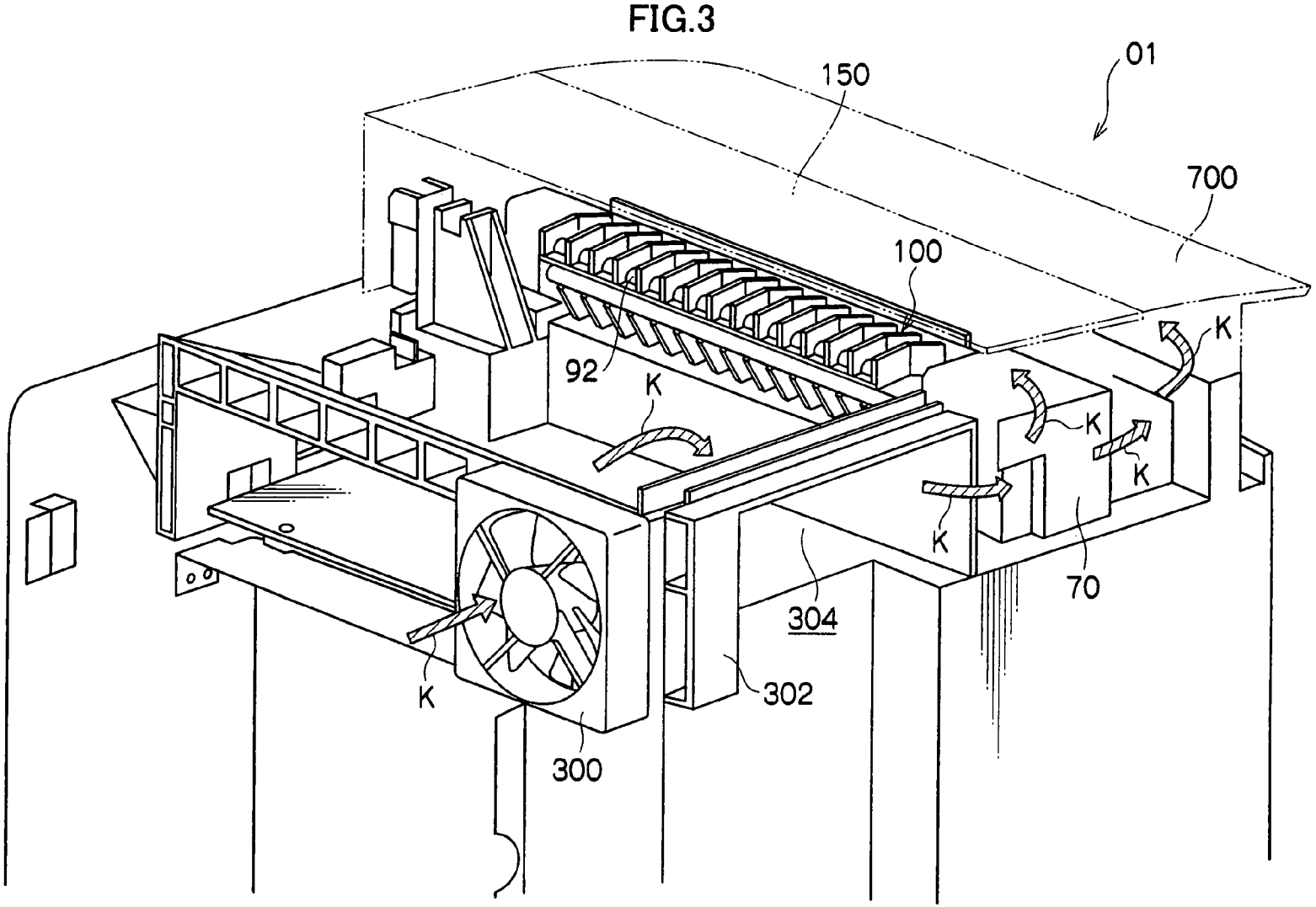
FIG. 3 is a view showing the airflow in the inner portion of the image formation apparatus.

As shown in FIG. 2, a suction air fan 300 is provided in an upper portion at the left side as seen from the front surface in the back side of the apparatus. The air sucked by the suction air fan 300 is introduced to a ventilation path 304 formed in a casing frame 302 or the like. Further, as shown in FIG. 3, the air is fed to the apparatus front surface side through a gap between a left side cover (not shown) and the casing frame 302. Further, the air is introduced to a ventilation path 504 constituted by the guiding guide 600 and the cover 700 (see FIGS. 4 and 5). In this case, the ventilation path 504 extends in a width direction of the recording paper P (an axis orthogonal to FIGS. 1, 4 and 5). Further, the air is blown from one side in the width direction (the left side as seen from the apparatus front surface) toward the other side (the right side as seen from the apparatus front surface).

Figure 6:
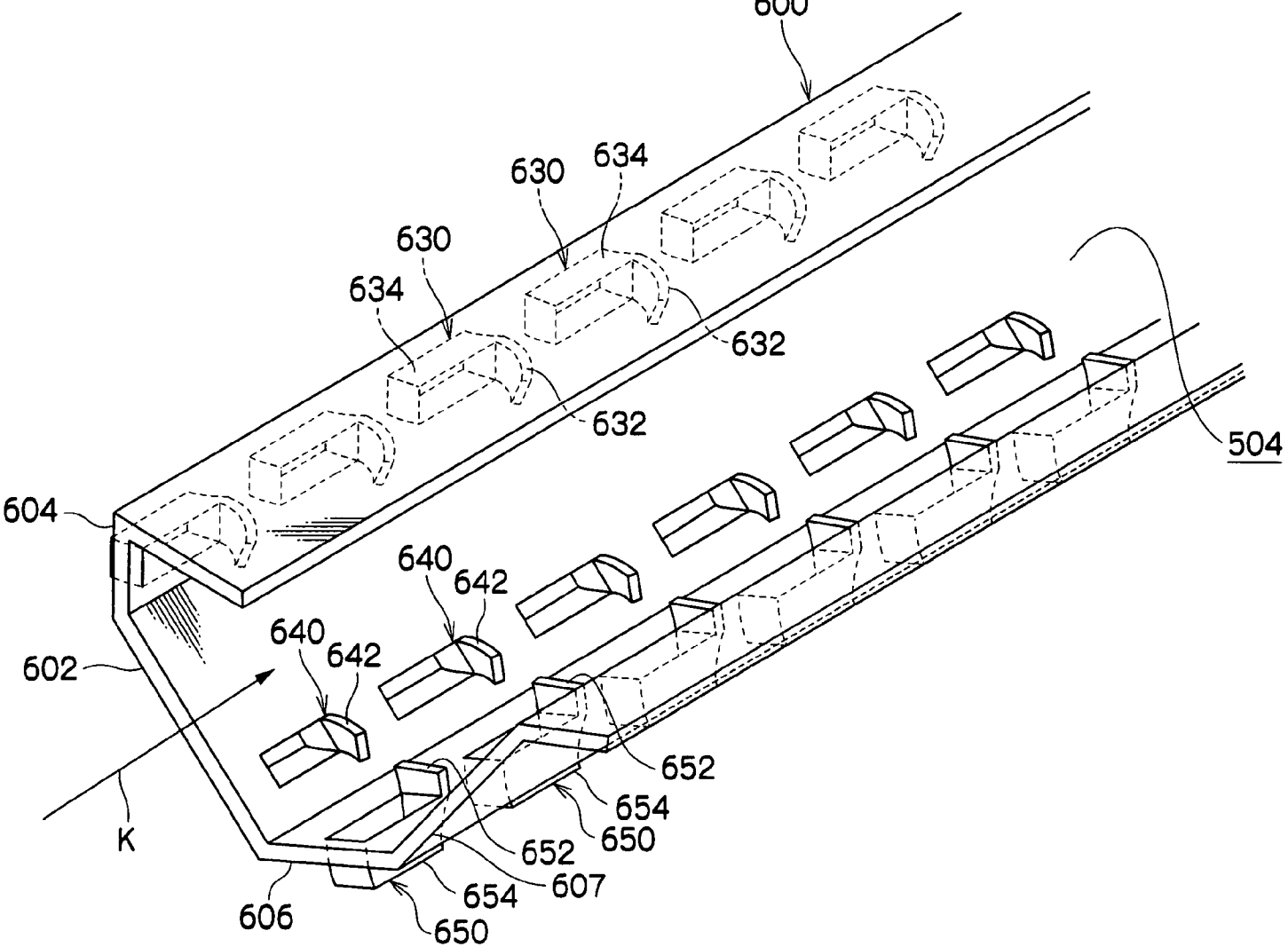
FIG. 6 is a perspective view showing a guiding guide.
Figure 7:
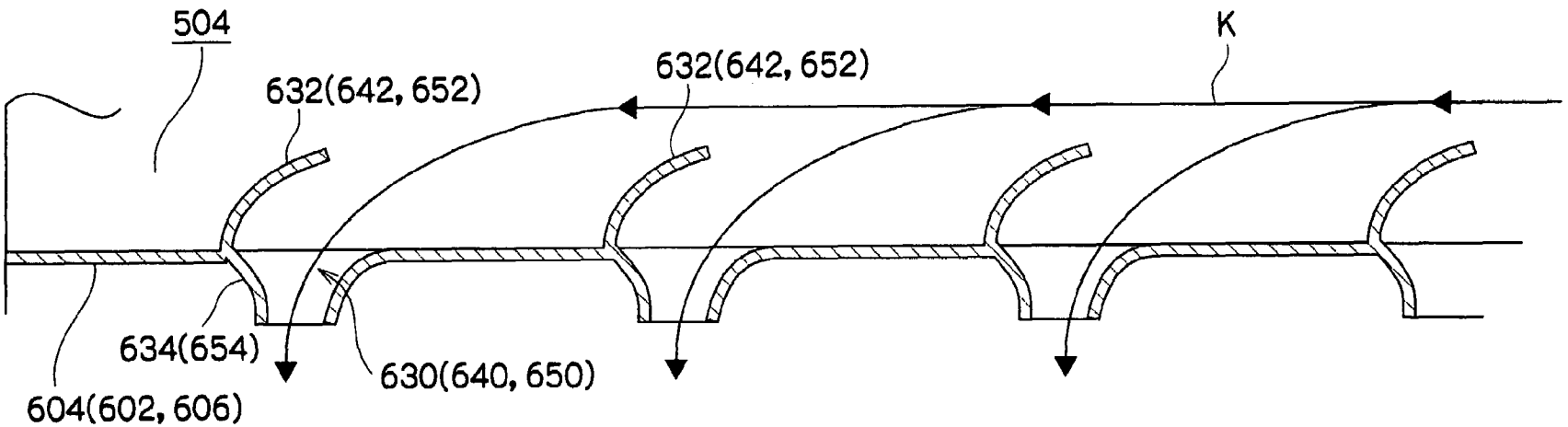
FIG. 7 is a view showing an airflow in a ventilation path constituted by the guiding guide and a cover.

In this case, as shown in FIGS. 6 and 7, an exhaust port 630 is provided in a side surface 604 of the guiding guide 600. The exhaust port 630 is provided with a nozzle 634 protruding from the side surface 604 and having a narrowed leading end. Further, an inner wall is provided with a guide plate 632 guiding the air to the nozzle 634.

Further, an exhaust port 640 is provided in the guide surface 602 of the guiding guide 600, and an exhaust port 650 is provided in a bottom surface 606. In this case, an opening area of the exhaust ports 630, 640 and 650 is smaller than a cross-sectional area in a blowing direction (a width direction) of the ventilation path 504.

Further, the exhaust port 650 is provided with a nozzle 654 and a guide plate 652 in the same manner as the exhaust port 630. However, the exhaust port 640 is provided with a guide plate 642, but is not provided with any nozzle. In other words, since the guide surface 602 does not have any projection (any nozzle), the convey of the recording paper P is not prevented. In this case, as a matter of convenience, all of the exhaust ports 630, 640 and 650 are explained by using FIG. 7, and it appears in FIG. 7 that the exhaust port 640 is provided with the nozzle; however, the exhaust port 640 is actually not provided with any nozzle as mentioned above. Further, the exhaust ports 630, 640 and 650 are all formed side by side in the width direction (the blowing direction).

Since the structure is made as mentioned above, the air blown from one side of the ventilation path 504 is cut off by a cutoff member (a casing (not shown) side surface, a side surface cover (not shown) and the like) in the other side, is introduced to the guide plates 632, 642 and 652, and is exhausted from the exhaust ports 640, 650 and 660. In this case, since the opening area of the exhaust ports 630, 640 and 650 is smaller than a cross-sectional area in the blowing direction (the width direction) of the ventilation path 504 as mentioned above, a flow rate of the exhaust air becomes fast.

Further, since the exhaust ports 630 and 650 are provided with the tapered nozzles 634 and 654, the flow rate of the exhaust air from the exhaust ports 630 and 650 becomes faster.

Further, as shown in FIGS. 4, 5 and 6, since the exhaust port 630 is provided near a leading end portion of a convex portion formed by an upper surface 620 and a side surface 604, a flow rate of the exhaust air from the exhaust port 630 becomes faster.

In the same manner, since the exhaust port 640 is provided near the leading end portion of the convex portion formed by the guide surface 602 and the bottom surface 606, and the exhaust port 650 is provided near the leading end portion of the convex portion formed by the bottom surface 606 and the side surface 507, the flow rate of the exhaust air from the exhaust ports 640 and 650 becomes faster.

In this case, as shown in FIGS. 4 and 5, the exhaust port 630 exhausts substantially horizontally from the front surface side of the apparatus to the back side. The exhausted air is discharged out of the machine through a space between the cover 150 and the carrier guide 100, a space between the carrier guide 100 and the gate 200 and the like.

The exhaust port 640 exhausts obliquely downward in the back side. The exhausted air is brought into contact with a detection sensor 90 detecting whether or not the recording paper P exists (detecting whether or not a jamming has occurred).

The exhaust port 650 exhausts to the double-sided carrier path 82 toward a lower side.

On the other hand, the air (see FIGS. 2 and 3) sucked by the suction air fan 300 mentioned above is introduced to an inner space 502 of the hollow gate 200 having the substantially triangular cross-sectional shape shown in FIGS. 4 and 5. In this case, the inner portion 502 of the gate 200 extends in the width direction, and the blowing direction is from one side (the left side as seen from the apparatus front surface) to the other side (the right side as seen from the apparatus front surface).

Figure 8:
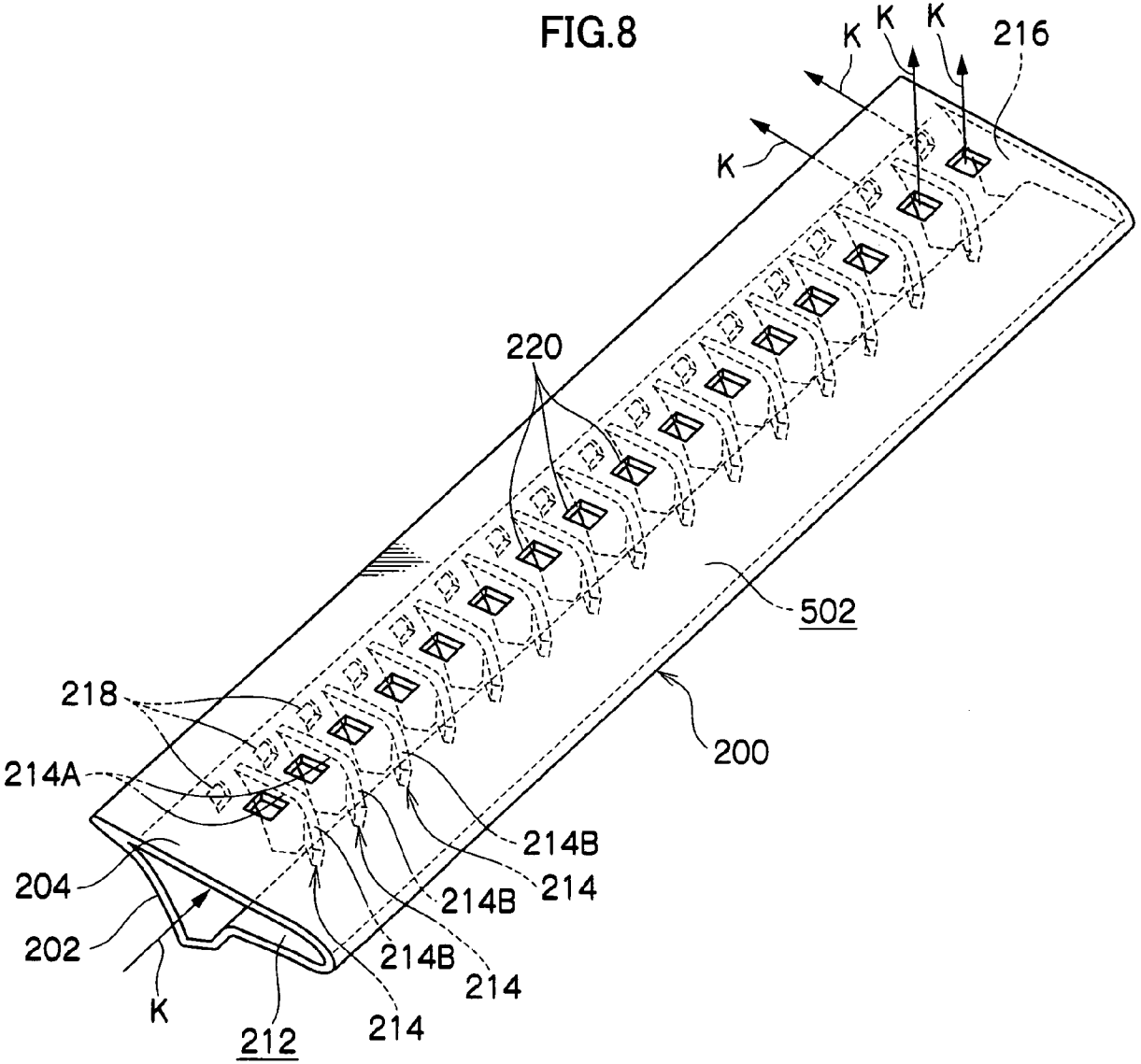
FIG. 8 is a perspective view showing the gate.

As shown in FIG. 8, an opening 212 is formed in an end portion in one side of the gate 200 (the left side as seen from the apparatus front surface), however, a wall 216 is formed in an end portion in the other side (the right side as seen from the apparatus front surface). Further, a plurality of exhaust holes 218 are formed in the first surface 202 of the gate 200. Further, a plurality of exhaust holes 220 are formed in the second surface 204.

In this case, both of the exhaust holes 218 and 220 are formed side by side in the width direction (the blowing direction).

Further, a plurality of ribs 214 are formed side by side in opposite inner wall surfaces to the first surface 202 and the second surface 204. The rib 214 is constituted by a leading end portion 214A and an inclined portion 214B inclined in an opposite direction to the blowing direction. In this case, the exhaust holes 218 and 220 mentioned above are formed between the ribs 214.

Since the structure is made as mentioned above, the air blown from one side of the inner space 502 from the opening 212 of the gate 200 is cut off by the cutoff member of the other side (the wall 216 in the present embodiment), is introduced by the rib 214 and is exhausted from a plurality of exhaust holes 218 and 220.

In this case, as shown in FIG. 4, in a state in which the gate 200 is rotated upward (in a state in which the recording paper P is guided by the first surface 202), the exhausting direction of the exhaust hole 218 of the first surface 202 is substantially the same direction as the carrier direction of the recording paper P, and a part of the exhaust air is brought into contact with the pinch roll 400. Further, the exhausting direction of the exhaust hole 220 of the second surface 204 is an upward direction.

Next, an operation of the present embodiment will be explained.

As shown in FIGS. 4 and 5, the air exhausted from the exhaust port 630 is blown against the recording paper P discharged from the gate 200, the carrier guide 100, the cover 150 and the fixing device 70. Further, the air is discharged out of the machine through the space between the cover 150 and the carrier guide 100, the space between the carrier guide 100 and the gate 200 and the like. Further, the air exhausted from the exhaust hole 218 of the gate 200 is blown against the recording paper P discharged from the fixing device 70, and is discharged out of the machine.

In this case, the air heated by the fixing device 70 ascends and is brought into contact with the gate 200, the carrier guide 100 and the cover 150 which are arranged in the upper side of the fixing device 70. A water vapor obtained by an evaporation of a water content contained in the recording paper P is included in the heated air. Accordingly, this may cause dew condensation in the gate 200, the carrier guide 100 and the cover 150.

However, as mentioned above, the gate 200, the carrier guide 100 and the cover 150 are cooled by the air exhausted from the exhaust port 630 of the guiding guide 600 and the exhaust hole 218 of the gate 200, and thus the dew condensation is prevented thereby. Further, the recording paper P after being fixed is cooled.

In this case, the air is blown in the width direction of the recording paper P, and is exhausted in the carrier direction (the direction orthogonal to the width direction). Accordingly, it is possible to substantially uniformly exhaust the air all around the width direction, and uniformly cool the recording paper P.

Further, in double-sided printing the recording paper P is fed to the nip portion N between the secondary intermediate transfer drum 53 and the final transfer roll 60 after fixing the full color toner image to one side of the recording paper P. However, it is necessary that the temperature of the recording paper P is equal to or less than a predetermined temperature at that time.

Accordingly, the recording paper P is cooled by blowing the air exhausted from the exhaust ports 630, 640 and 650 of the guiding guide 600 and the exhaust hole 220 of the gate 200 against the recording paper P conveyed in a switchback manner. In this case, as mentioned above, since the air is substantially uniformly exhausted all around the width direction, the recording paper P is uniformly cooled.

Further, the pinch roll 400 is arranged extremely near the fixing device 70. Accordingly, the temperature of the pinch roll 400 tends to become high. Further, if the full color toner image fixed to the surface of the recording paper P is brought into contact with the pinch roll 400 reaching the high temperature, there are cases in which gloss unevenness occurs, whereby gloss in the contact portion becomes uneven. Further, since the detection sensor 90 is also arranged extremely near the fixing device 70, the detection sensor 90 tends to reach the high temperature. If the detection sensor 90 reaches the high temperature, a malfunction is possibly caused.

Accordingly, the air exhausted from the exhaust port 640 of the guiding guide 600 and the exhaust hole 218 of the gate 200 is blown against the pinch roller 400 and the detection sensor 90 so as to cool it.

As described above, since the air is blown against the predetermined member (the gate 200, the carrier guide 100, the cover 150, the recording paper P, the pinch roller 400 and the detection sensor 90 in the present embodiment) so as to cool it, by utilizing the guiding guide 600 and the gate 200, a ventilation path is not independently required.

Further, as mentioned above, since the structure is made such that the flow rate of the exhaust air is fast, the cooling effect is high.

Since the exhausted air is not applied to the fixing device 70 (particularly, the heat roll 72) to which the exhaust air is desired not to be applied (the temperature of which is desired not to be reduced), that is, the heat of the fixing device 70 is not absorbed by the exhaust air, unnecessary surplus energy is not consumed.

In this case, the invention is not limited to the embodiment mentioned above.

For example, in the present embodiment, the sheet carrier is applied to the image formation apparatus 01 using the well-known electrophotographic system. However, the invention is not limited to this. For example, the invention can also be applied to various image formation apparatuses using an ink jet system, a thermal transfer system or the like. Further, the conveyed sheet is not limited to the recording paper P. For example, the invention can be applied to general sheets for recording such as an OHP sheet (transparency).

The sheet carrier according to the invention may be further structured such that the ventilation path extends in the width direction of the sheet.

In the structure mentioned above, the ventilation path extending in the width direction of the sheet is formed by utilizing the guide guiding the sheet without enlarging the size of the apparatus.

The sheet carrier according to the invention may be structured such that the blowing direction is in the width direction, and the exhausting is carried out in the direction orthogonal to the width direction.

In the structure mentioned above, the air is blown in the width direction with respect to the ventilation path extending in the width direction of the sheet, and the air is exhausted in the direction orthogonal to the width direction. Accordingly, even if the exhaust portion is provided at a predetermined position in the width direction, the air is exhausted substantially uniformly.

The sheet carrier according to the invention may be structured such that a plurality of exhaust portions may be formed in the structure mentioned above.

In the sheet carrier mentioned above, since a plurality of exhaust portions are formed, it is possible to cool a plurality of positions.

The sheet carrier according to the invention may be structured such that an opening area of the exhaust portion is smaller than a cross-sectional area in the blowing direction of the ventilation path in the structure mentioned above.

In the sheet carrier having the structure mentioned above, since the opening area of the exhaust portion is smaller than the cross-sectional area in the blowing direction of the ventilation path, the flow rate of the air blowing out from the exhaust portion becomes faster than the flow rate of the air flowing to the ventilation path. Accordingly, a high cooling effect can be obtained.

The sheet carrier according to the invention may be structured such that the exhaust portion is formed in a tapered shape having a tapered leading end in the structure mentioned above.

In the sheet carrier having the structure mentioned above, since the exhaust portion is formed in the tapered shape having the tapered leading end, the flow rate of the air blowing out from the exhaust portion becomes faster. Accordingly, a high cooling effect can be obtained. Further, it is possible to accurately exhaust in an aimed direction (toward the predetermined member).

The sheet carrier according to the invention may be structured such that the exhaust portion is formed in a leading end portion of a convex portion of the guide or near the leading end portion, in the structure mentioned above.

In the sheet carrier having the structure mentioned above, since the exhaust portion is formed in the leading end portion of the convex portion of the guide or near the leading end portion, the flow rate of the air blowing out from the exhaust portion becomes faster. Accordingly, a high cooling effect can be obtained.

The sheet carrier according to the invention may be structured such that the ventilation path is provided with a guide portion guiding the blown air to the exhaust portion, in the structure mentioned above.

In the sheet carrier having the structure mentioned above, since the ventilation path is provided with the guide portion guiding the blown air to the exhaust portion, it is possible to effectively blow out the air from the exhaust portion.

The image formation apparatus according to the invention is provided with the sheet carrier having any one of the structures mentioned above.

Since the image formation apparatus according to the invention is provided with the sheet carrier, it is possible to cool the predetermined member without enlarging the size of the apparatus.

The image formation apparatus according to the invention may be structured such that the predetermined member is provided near a fixing device fixing a toner image transferred to the sheet.

In the image formation apparatus according to the invention, the predetermined member near the fixing device fixing the toner image transferred to the sheet is heated by the heat of the fixing device. However, the air is blown against the predetermined member so as to cool it by utilizing the guide guiding the sheet without enlarging the apparatus in size.

In this case, although the air is blown against the predetermined member, the air is not applied to the fixing device. In other words, since the heat of the fixing device is not absorbed, unnecessary surplus energy is not consumed for maintaining the temperature necessary for fixing.

The image formation apparatus according to the invention may be structured such that the predetermined member is a detection sensor detecting whether or not the sheet exists.

In the image formation apparatus having the structure mentioned above, the air is blown against the detection sensor detecting whether or not the sheet exists and provided near the fixing device so as to cool it. Accordingly, it is possible to prevent the detection sensor from reaching a high temperature by the heat of the fixing device and causing a malfunction.

The image formation apparatus according to the invention may be structured such that the predetermined member is a contact member which the sheet discharged from the fixing device is brought into contact with and guided to.

In the image formation apparatus having the structure mentioned above, the air is blown against the contact member which the sheet discharged from the fixing device is brought into contact with and guided to so as to cool it. Accordingly, it is possible to prevent a problem in which the contact member reaches a high temperature due to the heat of the fixing device, for example, a gloss unevenness (an unevenness in a gloss of the image) caused by the sheet discharged from the fixing device being brought into contact with the contact member reaching a high temperature.

The image formation apparatus according to the invention may be structured such that the contact member is a pinch roller.

In the image formation apparatus having the structure mentioned above, the air is blown against the pinch roller so as to cool it. Accordingly, it is possible to prevent a problem caused by the pinch roller reaching a high temperature by the heat of the fixing device, for example, the gloss unevenness.

The image formation apparatus according to the invention may be structured such that the guide is a gate provided with a first surface guiding the sheet discharged from the fixing device in the discharging direction and a second surface guiding the sheet conveyed in a switchback manner after being guided by the first surface to the other carrier path, in any one of the structures mentioned above.

In the image formation apparatus having the structure mentioned above, the air is blown against the predetermined member by utilizing the gate provided with the first surface guiding the sheet discharged from the fixing device in the discharging direction, and the second surface guiding the sheet conveyed in the switchback manner after being guided by the first surface to the other carrier path, so as to cool it. Accordingly, it is possible to cool the predetermined member without enlarging the size of the apparatus.

The image formation apparatus according to the invention may be structured such that the guide is a guiding guide provided in the other carrier path to which the sheet carried in a switchback manner after being discharged from the fixing device is conveyed, in any one of the structures mentioned above.

In the image formation apparatus having the structure mentioned above, the air is blown against the predetermined member by utilizing the guiding guide provided in the other carrier path to which the sheet conveyed in the switchback manner is conveyed after being discharged from the fixing device, so as to cool it. Accordingly, it is possible to cool the predetermined member without enlarging the size of the apparatus.

The image formation apparatus according to the invention may be structured such that the predetermined member is a switch backed sheet.

In the image formation apparatus having the structure mentioned above, since the switchbacked sheet reaches a high temperature, the sheet is cooled by blowing the air.

As described above, according to the invention, there can be obtained an effect in which the air can be blown against the predetermined member without enlarging the size of the apparatus by utilizing the guide guiding the sheet so as to cool it.

Further, the invention can be applied to the sheet carrier mechanism used in the other apparatuses than the image formation apparatus. In this case, the conveyed sheet is not limited to the sheet for recording.

What is claimed is:

1. A sheet carrier comprising:

a guide guiding a sheet;

a ventilation path at least a part of which is constituted by said guide;

a blower portion; and an exhaust portion formed in said guide, exhausting air blown to said ventilation path by said blower portion and blowing the air against a predetermined member.

2. A sheet carrier as claimed in claim 1, wherein said ventilation path extends in the width direction of said sheet.

3. A sheet carrier as claimed in claim 2, wherein the blowing direction is said width direction, and the exhausting is carried out in the direction orthogonal to said width direction.

4. A sheet carrier as claimed in claim 1, wherein a plurality of said exhaust portions are formed.

5. A sheet carrier as claimed in claim 1, wherein an opening area of said exhaust portion is smaller than a cross-sectional area in the blowing direction of said ventilation path.

6. A sheet carrier as claimed in claim 1, wherein said exhaust portion is formed in a tapered shape having a tapered leading end.

7. A sheet carrier as claimed in claim 1, wherein said exhaust portion is formed in a leading end portion of a convex portion of said guide or near the leading end portion.

8. A sheet carrier as claimed in claim 1, wherein said ventilation path is provided with a guide portion guiding the blown air to said exhaust portion.

9. An image formation apparatus comprising said sheet carrier as claimed in claim 1.

10. An image formation apparatus as claimed in claim 9, wherein said predetermined member is provided near a fixing device fixing a toner image transferred to said sheet.

11. An image formation apparatus as claimed in claim 10, wherein said predetermined member is a detection sensor detecting whether or not said sheet exists.

12. An image formation apparatus as claimed in claim 10, wherein said predetermined member is a contact member, which said sheet discharged from said fixing device is brought into contact with and guided to.

13. An image formation apparatus as claimed in claim 12, wherein said contact member is a pinch roller.

14. An image formation apparatus as claimed in claim 10, wherein said guide is a gate provided with a first surface guiding said sheet discharged from said fixing device in the discharging direction and a second surface guiding said sheet conveyed in a switchback manner after being guided by said first surface to the other carrier path.

15. An image formation apparatus as claimed in claim 10, wherein said guide is a guiding guide provided in an other carrier path to which said sheet carried in a switchback manner after being discharged from said fixing device is conveyed.

16. An image formation apparatus as claimed in claim 14, wherein said predetermined member is a switchbacked sheet.

* * * * *